US010723969B2

(12) United States Patent
Rowland et al.

(10) Patent No.: US 10,723,969 B2
(45) **Date of Patent: *Jul. 28, 2020**

(54) LUBRICANT COMPOSITIONS STABILIZED BY MIXTURES OF DIARYLAMINE AND HYDROXYDIARYLAMINE ANTIOXIDANTS

(71) Applicant: LANXESS Solutions US Inc., Middlebury, CT (US)

(72) Inventors: Robert G. Rowland, Woodbridge, CT (US); Subban Ramesh, Spartanburg, SC (US)

(73) Assignee: LANXESS Solutions US Inc., Shelton, CT (US)

( * ) Notice: Subject to any disclaimer, the term of this patent is extended or adjusted under 35 U.S.C. 154(b) by 96 days.

This patent is subject to a terminal disclaimer.

(21) Appl. No.: 15/703,380

(22) Filed: Sep. 13, 2017

(65) Prior Publication Data

US 2018/0079987 A1 Mar. 22, 2018

Related U.S. Application Data

(60) Provisional application No. 62/463,831, filed on Feb. 27, 2017, provisional application No. 62/396,880, filed on Sep. 20, 2016.

(51) Int. Cl.

| | |
|---|---|
| ***C10M 141/06*** | (2006.01) |
| ***C10M 169/04*** | (2006.01) |
| ***C10M 133/54*** | (2006.01) |
| ***C10M 133/14*** | (2006.01) |
| ***C10M 105/00*** | (2006.01) |

(52) U.S. Cl.

CPC ..... *C10M 141/06* (2013.01); *C10M 105/00* (2013.01); *C10M 133/14* (2013.01); *C10M 133/54* (2013.01); *C10M 169/04* (2013.01); *C10M 2203/003* (2013.01); *C10M 2215/062* (2013.01); *C10M 2215/064* (2013.01); *C10M 2215/065* (2013.01); *C10M 2215/26* (2013.01); *C10N 2230/04* (2013.01); *C10N 2230/08* (2013.01); *C10N 2230/10* (2013.01); *C10N 2240/10* (2013.01)

(58) Field of Classification Search

CPC ..... C10M 141/06; C10M 133/54; C10M 169/04; C10M 105/00; C10M 133/14; C10M 2215/065; C10M 2215/26; C10M 2203/003; C10M 2215/062; C10M 2215/064; C10M 129/04; C10M 129/10; C10M 129/14; C10M 133/40; C10M 125/20; C10M 130/00; C10M 141/02; C10M 141/04; C10N 2230/10; C10N 2230/04; C10N 2240/10; C10N 2230/08

See application file for complete search history.

(56) References Cited

U.S. PATENT DOCUMENTS

| | | | | |
|---|---|---|---|---|
| 2,369,075 | A | 2/1945 | Robbins | |
| 3,751,472 | A | 8/1973 | Wheeler | |
| 3,781,203 | A | 12/1973 | Braid | |
| 3,781,206 | A * | 12/1973 | Braid | C08K 5/18 508/495 |
| 5,338,885 | A | 8/1994 | Immel et al. | |
| 5,449,829 | A | 9/1995 | Kusuda et al. | |
| 6,599,865 | B1 | 7/2003 | Esche, Jr. et al. | |
| 7,498,467 | B2 | 3/2009 | Shiraki | |
| 7,501,386 | B2 * | 3/2009 | Cherpeck | C07D 215/38 508/261 |
| 7,569,526 | B2 | 8/2009 | Costello et al. | |
| 7,704,931 | B2 | 4/2010 | Dong et al. | |
| 7,838,703 | B2 | 11/2010 | Ma et al. | |
| 8,017,805 | B2 * | 9/2011 | Nalesnik | C07C 211/55 252/68 |
| 8,202,829 | B2 | 6/2012 | Devlin et al. | |
| 2007/0082828 | A1 | 4/2007 | Nalesnik | |
| 2007/0142243 | A1 | 6/2007 | Cherpeck et al. | |
| 2007/0203035 | A1 * | 8/2007 | Dong | C10M 141/06 508/485 |
| 2007/0293408 | A1 | 12/2007 | Opstal et al. | |
| 2011/0237474 | A1 | 9/2011 | Mazzamaro et al. | |

FOREIGN PATENT DOCUMENTS

| | | | | |
|---|---|---|---|---|
| EP | 0165559 | A1 * | 12/1985 | C10M 133/14 |
| EP | 0165559 | A1 | 12/1985 | |
| GB | 1145189 | A * | 3/1969 | C10M 1/08 |
| GB | 1145189 | A | 3/1969 | |
| GB | 1393605 | A * | 5/1975 | C08K 5/18 |
| JP | 2011-256314 | A | 12/2011 | |
| WO | 2009067315 | A1 | 5/2009 | |
| WO | 2012146530 | A1 | 11/2012 | |

OTHER PUBLICATIONS

Lubricant Additives Chemistry and Applications 2nd Ed. Leslie Rudnick (p. 4-43 (Year: 2009).*

Lubricant Additives Vanderbilt (Year: 2015).*

Kyazim-Zade et al., Neftekhimiya, 36(1), 73-75, 1996, XP002775876, Abstract.

PCT International Search Report and Written Opinion dated Dec. 8, 2017 from corresponding Application No. PCT/US2017/051332, 18 pages.

Poliak et al., Polymer Degradation and Stability (2015) 114, 34-44.

Zhang et al., Organic Letters, 15(8), 2018-2021, 2013, XP002775496 Abstract.

Janik et al., Physica (Amsterdam), 77(3), 514-22, 1974, XP002775497 Abstract.

(Continued)

*Primary Examiner* — Pamela H Weiss

(57) ABSTRACT

Lubricant compositions comprising a lubricating oil and a mixture of one or more alkylated diarylamine and one or more alkylated hydroxydiarylamine exhibit excellent antioxidant and deposit control performance.

16 Claims, No Drawings

(56) References Cited

OTHER PUBLICATIONS

Jancevska-Ni Kolovska, Rad Jugoslavenske Akademije Znanosti I Umjetnosti, 398, 93-101, 1983, XP002775498 Abstract.
Soulie, Tetrahedron, 57 (6), 1035-1040, 2001 XP002775499 Abstract.
Zhang et al., Journal of the American Chemical Society, 134(12), 5492-5495, XP002775500 Abstract.

* cited by examiner

LUBRICANT COMPOSITIONS STABILIZED BY MIXTURES OF DIARYLAMINE AND HYDROXYDIARYLAMINE ANTIOXIDANTS

Lubricant compositions comprising a lubricating oil and a mixture of one or more alkylated diarylamine and one or more alkylated hydroxydiarylamine are provided, which compositions exhibit excellent antioxidant and deposit control activity.

BACKGROUND

Lubricants are often used in demanding environments where degradation can be accelerated by high temperatures, extreme wear conditions, acidic or other corrosive conditions, etc. For example, the conditions under which automobile engines function are severe enough to require periodic oil changes to replace degraded engine lubricant in order to protect the engine against wear and damage that can lead to catastrophic failure.

Alkylated diaryl amines, such as alkylated diphenylamines (ADPAs), are well known antioxidants widely used to prevent degradation and maintain the performance of engine oils found in gasoline and diesel engines for cars and trucks, as well as a variety of industrial lubricants and lubricants for marine engines, etc. When selecting a diaryl amine antioxidant a number of performance, safety and environmental concerns must be addressed. For example, diphenylamine itself has good antioxidant activity but is known to be a sensitizer and its presence is typically kept to a minimum, e.g., less than 1% of any ADPA antioxidant. Diphenylamines substituted with hydrocarbyl groups are more soluble in lubricating oil and the higher molecular weight reduces volatility. Increased alkylation also helps to solubilize polar materials formed from oligomerization of spent oxidized amines, which reduces deposits, sludge and varnish. On the other hand, the antioxidant activity of ADPAs is dependent on the concentration of nitrogen provided and is thus inversely proportional to molecular weight and so excessive alkylation or very large alkyl groups should be avoided. NAUGALUBE 438L, a mixture of diphenylamines alkylated by one or more nonyl-chains derived from propylene trimer is an effective and widely used liquid antioxidant Diaryl amines useful as anti-oxidants bearing substituents other than alkyl groups are known but such compounds are not as common in engine oils as alkyl substituted diaryl amines. For example, U.S. Pat. No. 7,704,931 includes 3-hydroxydiphenylamine and 4-hydroxydipenylamine in lists of possible antioxidants in a lubricant composition; U.S. Pat. No. 8,202,829 includes 3-hydroxydiphenylamine in a list of suitable antioxidants for use in a non-synthetic lubricating oil comprising less than 30 wt % monocycloparaffins and from 0.8 to 2.0 wt % tetracycloparaffins; and U.S. Pat. No. 7,569,526 includes 3-hydroxydiphenylamine and 4-hydroxydipenylamine in lists of possible antioxidants for use in the oil portion of a metal working fluid, but none of these three disclosures exemplify the use of a hydroxydiphenylamine.

U.S. Pat. No. 7,498,467 disclose aminophenol and hydroxydiphenylamine antioxidants wherein, on at least one phenyl ring, a hydroxyl substituent is adjacent to an amino substituent.

JP 2011-256314 discloses a composition comprising an aliphatic alkyl ester biodiesel fuel, which fuel may also contain a fossil fuel component, and an antioxidant of the formula

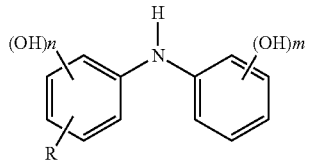

wherein n and M can be 0, 1 or 2 provided that m+n=1 or 2, and R is a C1-18 alkyl, which alkyl may be further substituted. Of the possible hydroxydiphenyl amine compounds of the above formula, only 4-hydroxydiphenylamine is exemplified.

GB 1,145,189 discloses the use of substituted 2-hydroxydiphenylamines as antioxidants in hydrocarbon and ester based lubricating oils.

EP 016559 discloses 3-hydroxy-4-styryldiphenylamine, which may also be further substituted by styryl at the 2- or 4'-positions, as an antioxidant for hydrocarbon and ester based lubricating oils. Compositions comprising ester based oils are exemplified.

"Thermoanalytic study of inhibitors of oxidation of synthetic oils" Kyazim-zade, A. K.; Gadirov, A. A.; Akchurina, T. Kh., Neftekhimiya (1996), 36(1), 73-75 investigated the thermal stability and the effect on the oxidation of pentaerythritol esters at elevated temperatures of certain 3-hydroxyl or 3-alkoxy-4-hexyldiarylamines of the following formula:

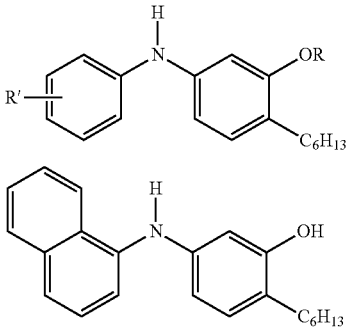

wherein R is hydrogen, butyl or hexyl and R' is hydrogen or methyl.

Degradation of lubricating oil, such as oil in engine lubricants, can cause many undesirable effects, such as the formation of deposits, changes in viscosity and lubrictity, etc. A number of tests are commonly used in the industry to evaluate the effectiveness of antioxidants in lubricant compositions, e.g., TEOST measures deposits, PDSC is used to measure the onset of appreciable oxidation chemistry, etc.

It has been found that lubricating oil compositions comprising mixtures of an alkylated diarylamine, such as the commercially available nonyl-substituted diphenylamine NAUGALUBE 438L, with certain alkylated hydroxydiarylamines, i.e., alkylated diarylamines substituted by hydroxyl on one or more aromatic ring carbon atoms, exhibit excellent antioxidant and/or deposit control activity that in many cases is superior to the performance the alkylated diarylamine or alkylated hydroxydiarylamine alone.

SUMMARY

Provided is a lubricating oil composition comprising a) a lubricating oil, and b) a mixture of:

i) an alkylated hydroxydiarylamine of formula I or II,

I

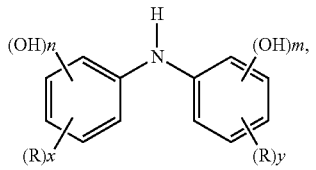

II

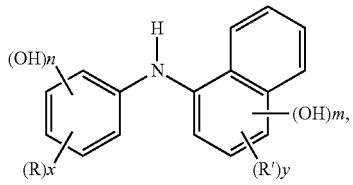

wherein n is 1 or 2; m is 0, 1 or 2; typically n is 1 and m is 0 or 1, and in many embodiments n is 1 and m is 0;

x is 0, 1 or 2 and y is 0, 1, 2 or 3, provided that at least one of x and y is other than 0; in many embodiments x is 0 or 1 and y is 1, 2 or 3;

each R is independently $C_{1-24}$, $C_{4-24}$ or $C_{4-18}$ alkyl, $C_{7-18}$ aralkyl, or $C_{4-24}$ or $C_{4-18}$ alkyl substituted by one or more hydroxyl or interrupted by one or more oxygen atom, or two adjacent R groups together with the carbons to which they are attached form a 5 to 8 member heterocyclic ring or a 6 to 8 member non-aromatic carbocyclic ring, which heterocyclic or non-aromatic carbocyclic ring is optionally substituted by alkyl, e.g., $C_{1-4}$ alkyl, hydroxyl or alkoxy;

each R' is independently $C_{1-24}$, $C_{4-24}$ or $C_{4-18}$ alkyl, $C_{7-18}$ aralkyl, or $C_{4-24}$ or $C_{4-18}$ alkyl substituted by one or more hydroxyl or interrupted by one or more oxygen atom, and wherein at least one carbon atom adjacent to the amine nitrogen is unsubstituted, i.e., is substituted only by hydrogen; and ii) an alkylated diarylamine.

The lubricating oil compositions of the invention generally exhibit superior deposit control and/or oxidation onset performance relative to compositions comprising the alkylated hydroxydiaryl amine or alkylated diarylamine alone.

In many embodiments, the alkylated hydroxydiarylamine comprises a compound substituted by hydroxyl on a phenyl ring at the 2- or 3-position relative to the amine, and in certain embodiments the alkylated hydroxydiarylamine comprises a compound substituted by hydroxyl at the 3-position.

In the present disclosure, the article "a" or "an" in relation to component means "one or more than one" unless otherwise specified.

In many embodiments, the mixture of alkylated hydroxydiarylamine and alkylated diarylamine is present from about 0.1 to about 5.0 wt %, e.g., 0.5 to 5 wt %, 0.5 to 3 wt %, or 1 to 3 wt %, based on the weight of the lubricating oil composition. Another embodiment provides a master batch or concentrate wherein the mixture of alkylated hydroxydiarylamine and alkylated diarylamine is present in greater amounts, for example from greater than 5 to 50 wt %, from 7 to 40 wt %, or from 10 to 35 wt %.

In one particular embodiment the lubricating oil comprises one or more hydrocarbon base stocks; however, in other embodiments other types of base stocks and mixtures of various types of base stocks are used.

DESCRIPTION

The lubricating oil compositions of the invention comprise a mixture of i) one or more alkylated hydroxydiarylamine of formula I or II, and ii) one or more alkylated diarylamine.

The alkylated hydroxydiarylamine of the invention is a compound of formula I or II,

I

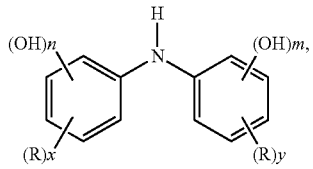

II

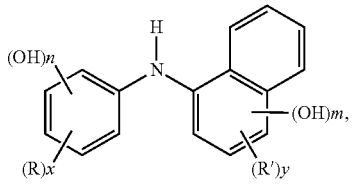

wherein n is 1 or 2; m is 0, 1 or 2; typically, n is 1 and m is 0 or 1, and in many embodiments n is 1 and m is 0;

x is 0, 1 or 2 and y is 0, 1, 2 or 3, provided that at least one of x and y is other than 0; in many embodiments x is 0 or 1 and y is 1, 2 or 3;

each R is independently $C_{1-24}$, $C_{4-24}$ or $C_{4-18}$ alkyl, $C_{7-18}$ aralkyl, or $C_{4-24}$ or $C_{4-18}$ alkyl substituted by one or more hydroxyl or interrupted by one or more oxygen atom, or two adjacent R groups together with the carbons to which they are attached form a 5 to 8 member heterocyclic ring or a 6 to 8 member non-aromatic carbocyclic ring, which heterocyclic or non-aromatic carbocyclic ring is optionally substituted by alkyl, e.g., $C_{1-4}$ alkyl, hydroxyl or alkoxy;

each R' is independently $C_{1-24}$, $C_{4-24}$ or $C_{4-18}$ alkyl, $C_{7-18}$ aralkyl, or $C_{4-24}$ or $C_{4-18}$ alkyl substituted by one or more hydroxyl or interrupted by one or more oxygen atom, and wherein at least one carbon atom adjacent to the amine nitrogen is unsubstituted, i.e., is substituted only by hydrogen; and ii) an alkylated diarylamine.

Typically, at least one R or R' group in formula I or II will contain at least 4 carbon atoms, e.g., at least one R or R' group will contain at least 6, 10, 12 or more carbon atoms.

When two adjacent R groups together with the carbons to which they are attached form a 5 to 8 member heterocyclic ring, the heterocyclic ring may be aromatic or non-aromatic and typically comprises a nitrogen, oxygen or sulfur atom.

In many embodiments, each R is independently $C_{1-24}$, $C_{4-24}$ or $C_{4-18}$ alkyl (i.e. alkyl unsubstituted by hydroxyl and uninterrupted by oxygen), or two adjacent R groups together with the carbons to which they are attached form a 6 to 8 member non-aromatic carbocyclic ring, which ring is optionally substituted by $C_{1-4}$ alkyl; for example, two adjacent R groups forming a non-aromatic 6 membered ring on a compound of formula I may create a tetrahydronaphthyl ring system as in:

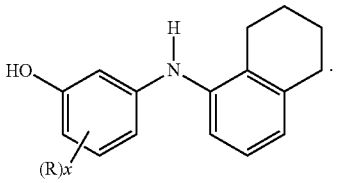

Frequently, R is $C_{1-24}$, $C_{4-24}$ or $C_{4-18}$ alkyl. In many embodiments, each R' is independently $C_{1-24}$, $C_{4-24}$ or $C_{4-18}$ alkyl.

R or R' as alkyl is a straight chain, branched chain, cycloalkyl or substituted cycloalkyl having the specified number of carbons and includes e.g., methyl, ethyl, propyl, butyl, pentyl, hexyl, heptyl, octyl, nonyl, decyl, undecyl, dodecyl, tetradecyl, hexadecyl, octadecyl, icosane, docosane, tetracosane etc., and isomers thereof, including, as non-limiting branched alkyl examples, iso-propyl, iso-butyl, sec-butyl, tert-butyl, iso-amyl, tert-amyl, methyl hexyl, ethyl hexyl, t-octyl, methyloctyl, ethylheptyl, propylhexyl, dimethylbutyl, dimethyheptyl, trimethylhexyl, tetramethylpentyl, ethylmethylhexyl, ethyl dimethyl pentyl, diethyl pentyl, isopropylhexyl, and the like.

In the present application, "alkyl" in general relates to straight chain, branched chain, or cyclic alkyl. Unless otherwise specified, terms such as "octyl" or "nonyl" and the like relate to a straight or branched chain alkyl. The above descriptions incorporate the term "and isomers thereof" as a formal acknowledgement of this and in order to avoid confusion. It is noted that many reactions used to alkylate an aromatic ring make use of oligomers formed from smaller olefins, such as propylene trimers, tetramers or pentamers, and the alkyl substituents formed therefrom are referred to herein as nonyl, dodecyl and pentadecyl.

R or R' as $C_{7-18}$ aralkyl is a straight or branched chain alkyl substituted by phenyl or naphthyl, which phenyl or naphthyl may be substituted by alky, wherein the total number of carbon atoms is from 7 to 18 and includes, e.g., benzyl, 1 or 2-phenethyl, cumyl, 1, 2 or 3-phenyl propyl, butylphenethyl, and the like.

R or R' as alkyl interrupted by one or more oxygen atom is an ether or polyether of the specified number of carbons, wherein the alkyl segments may be straight chain, branched chain, cycloalkyl or substituted cycloalkyl, e.g., ethoxyethyl, propoxypropyl, butoxybutyl, hexyloxyhexyl, tert-butoxypropyl, tert-butoxybutyl, 2-ethylhexyloxyethyl and the like, a polyalkylene ether presented by the general formula $R'O(R'O)_nR''$, wherein each R' is independently $C_{2-6}$ alkylene, R'' is $C_{2-6}$ alkyl, and n is a number of from 1 to 12, provided that the total number of carbons is from 4 to 24 or 4 to 18.

Typically, the alkylated hydroxydiarylamine of component i) comprises one or more compound of formula I or II wherein 1 or 2 of the carbon atoms of the diarylamine are substituted by hydroxyl, typically, at least one carbon atom of at least one phenyl ring will be substituted by hydroxyl. In certain embodiments, the alkylated hydroxydiarylamine of component i) comprises an alkylated hydroxydiarylamine wherein at least one hydroxyl is attached to a phenyl carbon at the 2- or 3-position relative to the amine, for example, the 3-position relative to the amine. In particular embodiments, component i) comprises one or more alkylated hydroxydiarylamines wherein from 50 to 100 wt % are substituted on phenyl by a hydroxyl at a 2- or 3-position relative to the amine and in certain specific embodiments, less than 10%, e.g., from 0 to 5 wt %, by weight of the more alkylated hydroxydiarylamines bear a hydroxyl group at a 4-position relative to the amine.

For example, in many embodiments the alkylated hydroxydiarylamine of component i) comprises an alkylated mono-hydroxyl diarylamine compound of formula III, IV, V or VI,

III

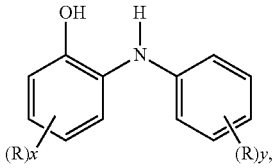

IV

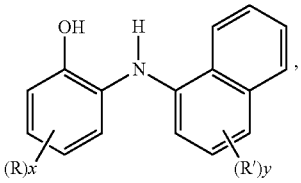

V

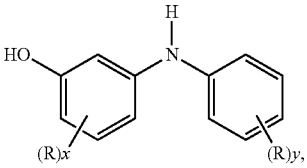

VI

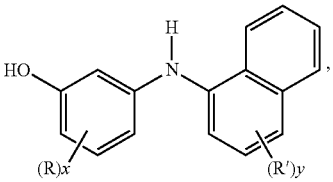

wherein R, x and y are as defined above.

In one embodiment, the invention provides a lubricating oil composition comprising a) a lubricating oil, and b) a mixture comprising:

i) from about 10 to about 90 wt % of an alkylated hydroxydiarylamine of formula I or II, and ii) from about 10 to about 90 wt % of an alkylated diarylamine, typically an alkylated diphenylamine, based on the combined weight of i and ii.

In some embodiments, the mixture of b comprises from about 20 to about 90 wt % or from about 10 or 20 to about 80 wt %, e.g., about 25 to about 75 wt %, e.g., from about 25 to about 50 wt % of component i) and from about 20 to about 90 wt % or from about 10 or 20 to about 80 wt %, e.g., about 25 to about 75 wt %, e.g., from about 50 to about 75 wt % of component ii).

The alkylated diarylamine of component ii) comprises one or more alkylated diarylamines, typically at least one alkylated diphenylamine, many of which are commercially available. For example, ii) generally comprises one or more compounds of the formula X:

X

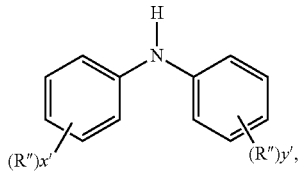

wherein x' is 1 or 2 and y' is 0, 1 or 2 and each R" independently from each other is $C_{1-24}$ alkyl. Typically, R' is $C_{1-18}$, $C_{4-18}$ or $C_{4-12}$ alkyl.

For example, in particular embodiments, component ii) comprises one or more alkylated diphenylamines of formula XII or XIII,

XII

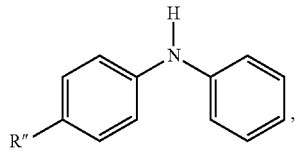

XIII

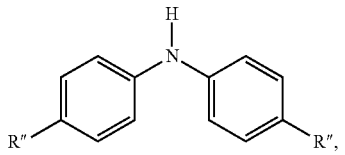

wherein each R is independently $C_{1-18}$ or $C_{4-12}$ alkyl. Other alkylated diphenylamines may also be present, such as tri- and tetra-alkylated compounds; and small amounts of unsubstituted diphenylamine may be present, i.e., less than 2 wt % and typically less than 1 wt % of all diarylamines. In many embodiments, greater than 50% by weight, often greater than 70 or 80% by weight, of component ii) is one or more compounds of formula XII and/or XIII. As stated above, a variety of commercial materials can be used in component ii), for example, NAUGALUBE 438L, which is a mixture of diphenylamines alkylated by one or more nonyl groups.

Other optional additives as known in the art may be present in the inventive lubricating oil composition. For example, commercial lubricant formulations typically contain a variety of other additives, for example, dispersants, detergents, corrosion/rust inhibitors, other antioxidants including amine, phenol or phosphorus antioxidants, anti-wear agents, anti-foamants, friction modifiers, seal swell agents, demulsifiers, V.I. improvers, pour point depressants, and the like. A sampling of these additives can be found in, for example, U.S. Pat. Nos. 5,498,809 and 7,696,136, the relevant portions of each disclosure is incorporated herein by reference, although the practitioner is well aware that this comprises only a partial list of available lubricant additives. It is also well known that one additive may be capable of providing or improving more than one property, e.g., an anti-wear agent may also function as a friction modifier and/or an extreme pressure additive.

The lubricant compositions of this invention will generally contain a combination of the alkylated hydroxydiarylamine of component i) and the alkylated diarylamine of component ii) along with other additives, in a combined concentration ranging from about 0.5 to about 30 weight percent, e.g., from about from about 1 to about 10 weight percent based on the total weight of the oil composition. For example, in some embodiments the combined additives are present from about 1 to about 5 weight percent.

Another embodiment provides a master batch or concentrate wherein the mixture of alkylated hydroxydiarylamine and alkylated diarylamine are present in greater amounts than in a final lubricant compositions, i.e., the lubricant composition present during operation of the engine or device, for example from greater than 5 to 50 wt %, from 7 to 40 wt %, or from 10 to 35 wt %. In such master batches or concentrates, any other additives will also typically be present in higher amounts than in a final lubricant composition.

The following table shows the results from standard TEOST deposit formation testing and standard PDSC oxidation onset testing of lubricating oil compositions comprising a commercial grade hydrocarbon engine oil and 1.5 wt % of various alkylated hydroxydiarylamines including 3-hydroxydiarylamines, i.e., compounds from Examples 5, 6 and 7; and 2-hydroxydiarylamines, i.e., compounds from Examples 8 and 9. Also shown are the results obtained from compositions comprising 1.5 wt % of a 1:1 mixture, by weight, of said hydroxydiarylamines and the commercial diphenylamine NAUGALUBE 438L, and data from a lubricating oil composition comprising 1.5 wt % of NAUGALUBE 438L as a standard formulation. Data obtained using alkylated 4-hydroxydiarylamines can be found in the Examples. The TEOST data is in mg of deposits, a lower value means less deposits, and the PDSC data is in minutes until onset of oxidation, a higher value represent greater protection.

5

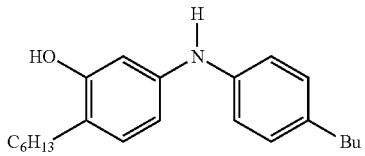

6

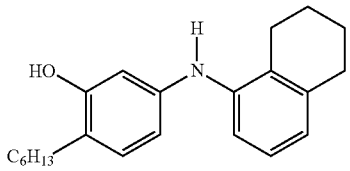

7

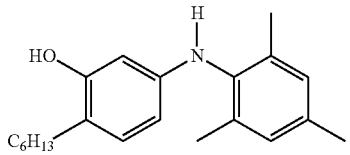

8

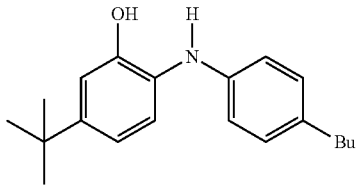

-continued

9

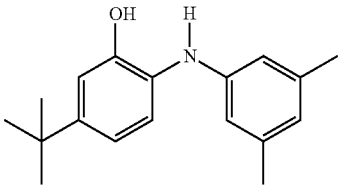

TEOST/PDSC results at 1.5 wt % additive

| | Single Diarylamine | | Mixture w/ 50% NL 438L | |
|---|---|---|---|---|
| | TEOST | PDSC | TEOST | PDSC |
| 438L Standard | 50.8 | 18.6 | — | — |
| Ex 5 | 47.6 | 12.3 | 25.3 | 19.5 |
| Ex 6 | 37.4 | 13.0 | 16.4 | 23.6 |
| Ex 7 | 31.4 | 6.7 | 28.5 | 14.5 |
| Ex 8 | 24.6 | 10.7 | 18.5 | 14.5 |
| Ex 9 | 44.0 | 6.1 | 33.2 | 10.5 |

Results from TEOST and PDSC testing at 3 wt % loadings are shown below for compound 12 and 10 alone and in mixtures with NAUGALUBE 438L, NAUGALUBE APAN (alkylated phenyl naphthyl amine) or NAUGALUBE 531 (hindered phenol).

10

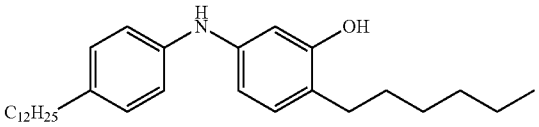

12

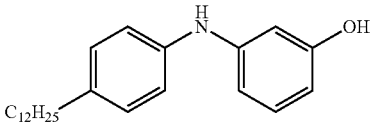

TEOST/PDSC results at 3 wt % Additive

| | Single Diarylamine | | Mixture w/50% NL 438L | | 25% NL 438L/ 75% Inventive Ex | |
|---|---|---|---|---|---|---|
| | TEOST | PDSC | TEOST | PDSC | TEOST | PDSC |
| 438L Standard | 20.7 | 26.7 | — | — | — | — |
| Ex 12 | 9.4 | 46.6 | 6.8 | 46.6 | 9.3 | 52.5 |
| Ex 10 | 6.4 | 19.5 | 10.6 | 30 | — | — |

TEOST/PDSC results at 3 wt % Additive

| | Single Compound | | Mixture w/50% NL APAN | | Mixture w/50% NL 531 | |
|---|---|---|---|---|---|---|
| | TEOST | PDSC | TEOST | PDSC | TEOST | PDSC |
| NL APAN | 16.3 | 22.1 | — | — | — | — |
| NL 531 | 50.2 | — | 10.2 | — | — | — |
| Ex 12 | 9.4 | 46.6 | 10.4 | 39.4 | 21.3 | — |
| EX 10 | 6.4 | 19.5 | 8.6 | 27 | 13.5 | |

The lubricating oil of the invention can be any suitable oil of lubricating viscosity as described for example in co-pending U.S. application Ser. No. 12/371,872, the relevant portions of which are incorporated herein by reference. For example, a lubricating oil base stock is any base stock, or mixtures thereof, having a kinematic viscosity at 100° C. of about 2 to about 200 cSt, about 3 to about 150 cSt, and often about 3 to about 100 cSt. Suitable lubricating oil base stocks include, for example, mineral oils such as those derived from petroleum, oils derived from coal or shale, animal oils, vegetable oils and synthetic oils. The relevant portions of co-pending U.S. application Ser. No. 12/371,872 are incorporated herein by reference.

Synthetic oils include hydrocarbon oils and halo-substituted hydrocarbon oils, such as polymerized and interpolymerized olefins, gas-to-liquids prepared by Fischer-Tropsch technology, alkylbenzenes, polyphenyls, alkylated diphenyl ethers, alkylated diphenyl sulfides, as well as their derivatives, analogs, homologs, and the like. Synthetic lubricating oils also include alkylene oxide polymers, interpolymers, copolymers, and derivatives thereof, wherein the terminal hydroxyl groups have been modified by esterification, etherification, etc. Another suitable class of synthetic lubricating oils comprises the esters of dicarboxylic acids with a variety of alcohols. Esters useful as synthetic oils also include those made from monocarboxylic acids or diacids and polyols and polyol ethers. Other esters useful as synthetic oils include those made from copolymers of α-olefins and dicarboxylic acids which are esterified with short or medium chain length alcohols.

The synthetic oils may comprise at least one of an oligomer of an α-olefin, an ester, an oil derived from a Fischer-Tropsch process, and a gas-to-liquid stock. Synthetic base stock lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1 octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs, and homologs thereof.

Silicon-based oils, such as the polyalkyl-, polyaryl-, polyalkoxy-, or polyaryloxy-siloxane oils and silicate oils, comprise another useful class of synthetic lubricating oils. Other synthetic lubricating oils include liquid esters of phosphorus-containing acids, polymeric tetrahydrofurans, poly alphaolefins, and the like.

Lubricating oil base stocks derived from the hydroisomerization of wax may also be used, either alone or in combination with the aforesaid base stocks. Such wax isomerate oil is produced by the hydroisomerization of waxes or mixtures thereof over a hydroisomerization catalyst. Natural waxes are typically the slack waxes recovered by the solvent dewaxing of mineral oils; synthetic waxes are typically the waxes produced by the Fischer-Tropsch process.

In many embodiments, the oil base stock comprises mineral oils. For example, the lubricating oil of the invention may be a petroleum oil, or a mixture comprising a petroleum oil. Many other embodiments include vegetable oils, paraffinic oils, naphthenic oils, aromatic oils, and derivatives thereof, often as combination of base stocks.

Useful base stocks from vegetable and animal sources include, for example, alkyl esters of fatty acids, which include commercial mixtures of the ethyl, propyl, butyl and especially methyl esters of fatty acids with 12 to 22 carbon atoms. For example, lauric acid, myristic acid, palmitic acid, palmitoleic acid, stearic acid, oleic acid, elaidic acid, petroselic acid, ricinoleic acid, elaeostearic acid, linoleic acid, linolenic acid, eicosanoic acid, gadoleic acid, docosanoic acid, or erucic acid are useful and have an iodine number from 50 to 150, especially 90 to 125. Mixtures with particularly advantageous properties are those which contain mainly, i.e., at least 50 wt. %, methyl esters of fatty acids with 16 to 22 carbon atoms and 1, 2, or 3 double bonds. The preferred lower alkyl esters of fatty acids are the methyl esters of oleic acid, linoleic acid, linolenic acid, and erucic acid.

Often the base stock of lubricating viscosity can comprise a Group I, Group II, or Group III base stock or base oil blends of the aforementioned base stocks, for example, the oil of lubricating viscosity is a Group II or Group III base stock, or a mixture thereof, or a mixture of a Group I base stock and one or more of a Group II and Group III. Generally, a major amount of the oil of lubricating viscosity is a Group II, Group III, Group IV, or Group V base stock, or a mixture thereof. The base stock, or base stock blend, typically has a saturate content of at least 65%, e.g., at least 75% or at least 85%. Most preferably, the base stock, or base stock blend, has a saturate content of greater than 90%.

Definitions for the base stocks and base oils in this invention are the same as those found in the American Petroleum Institute (API) publication "Engine Oil Licensing and Certification System," Industry Services Department (14th ed., December 1996), Addendum 1, December 1998. This publication categorizes base stocks as follows.

(a) Group I base stocks contain less than 90 percent saturates (as determined by ASTM D 2007) and/or greater than 0.03 percent sulfur (as determined by ASTM D 2622, ASTM D 4294, ASTM D 4927 and ASTM D 3120) and have a viscosity index greater than or equal to 80 and less than 120 (as determined by ASTM D 2270).

(b) Group II base stocks contain greater than or equal to 90 percent saturates (as determined by ASTM D 2007) and less than or equal to 0.03 percent sulfur (as determined by ASTM D 2622, ASTM D 4294, ASTM D 4927 and ASTM D 3120) and have a viscosity index greater than or equal to 80 and less than 120 (as determined by ASTM D 2270).

(c) Group III base stocks contain greater than or equal to 90 percent saturates (as determined by ASTM D 2007) and less than or equal to 0.03 percent sulfur (as determined by ASTM D 2622, ASTM D 4294, ASTM D 4927 and ASTM D 3120) and have a viscosity index greater than or equal to 120 (as determined by ASTM D 2270).

(d) Group IV base stocks are polyalphaolefins (PAO).

(e) Group V base stocks include all other base stocks not included in Groups I, II, III, or IV.

The lubricating oil compositions of the invention can be used in a variety of applications, for example, crankcase lubricating oils for spark-ignited and compression-ignited internal combustion engines, gas engine lubricants, wind turbine lubricants, automatic transmission fluids, gear lubricants, compressor lubricants, metal-working lubricants, hydraulic fluids, and other lubricating oil and grease compositions.

EXAMPLES

Example 1: 4-hydroxy-3-tert-butyl-4'-butyldiphenylamine

A 1:1 molar ratio of 4-butylaniline and tert-butylhydroxyquinone was heated at 220-240 C in the presence of 6 wt % triphenylphosphite, based on the weight of tert-butylhydroxyquinone, for approximately 8 hours to yield the crude product as a solid which was melted, stirred in the presence of a 5% ethyl acetate/hexane mixture at 60 C, which mixture was cooled to room temperature and silica gel was added. The mixture was stirred then filtered and filtrate was subjected to distillation to provide the product.

Example 2-9

Using a procedure similar to that of Example 1, a series of alkylated hydroxydiphenylamines was prepared from aniline and dihydroxybenzene derivatives as shown in Table 1.

TABLE 1

| Product of Example | aniline derivative | dihydroxybenzene derivative |
|---|---|---|
| 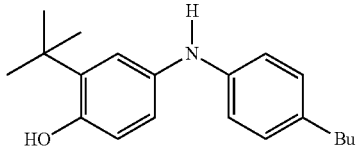 1 | 4-butylaniline | tert-butylhydroxyquinone |
| 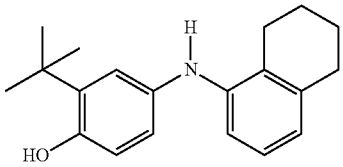 2 | 5,6,7,8-tetrahydronaphthylamine | tert-butylhydroxyquinone |

TABLE 1-continued
| Product of Example | aniline derivative | dihydroxybenzene derivative |
|---|---|---|
| 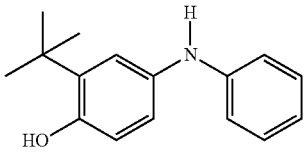 3 | aniline | tert-butylhydroxyquinone |
| 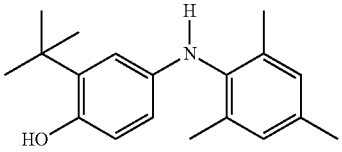 4 | 2,4,6-trimethylaniline | tert-butylhydroxyquinone |
| 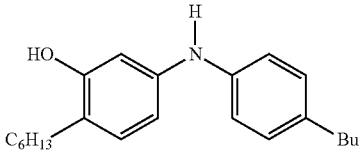 5 | 4-butylaniline | 4-hexylresorcinol |
| 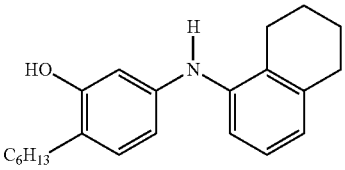 6 | 5,6,7,8-tetrahydronaphthylamine | 4-hexylresorcinol |
| 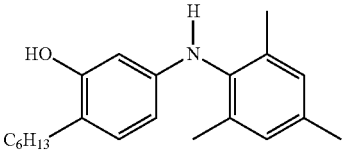 7 | 2,4,6-trimethylaniline | 4-hexylresorcinol |
| 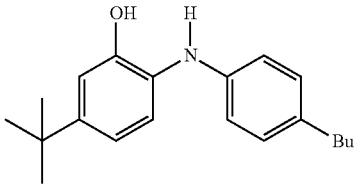 8 | 4-butylaniline | 4-tert-butylcatechol |
| 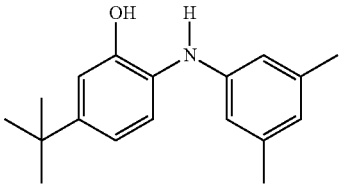 9 | 3,5-dimethylaniline | 4-tert-butylcatechol |

Results from TEOST and PDSC testing at 1.5 wt % loadings are shown in Table 2 for each compound 1-9 alone, and in mixtures with NAUGALUBE 438L or NAUGALUBE 750.

TABLE 2

TEOST/PDSC results at 1.5 wt % additive

| | Single Diphenylamine | | Mixture w/50% NL 438L | | Mixture w/75% *Alkyldiphenylamine | |
|---|---|---|---|---|---|---|
| Diphenylamine | TEOST | PDSC | TEOST | PDSC | TEOST | PDSC |
| 438 L Standard | 50.8 | 18.6 | | | | |
| Ex 1 | — | — | — | — | ~19 w/NL438L | ~18.7 w/NL438L |
| Ex 2 | — | — | — | — | ~40 w/NL750 | ~19 w/NL438L |
| Ex 3 | 95.3 | 4.0 | 56.9 | 13.0 | | |
| Ex 4 | 85.3 | 4.25 | — | — | | |
| Ex 5 | 47.6 | 12.25 | 25.3 | 19.5 | | |
| Ex 6 | 37.4 | 13.0 | 16.4 | 23.6 | | |
| Ex 7 | 31.4 | 6.7 | 28.5 | 14.5 | | |
| Ex 8 | 24.6 | 10.7 | 18.5 | 14.5 | | |
| Ex 9 | 44.0 | 6.13 | 33.15 | 10.51 | | |

Example 10

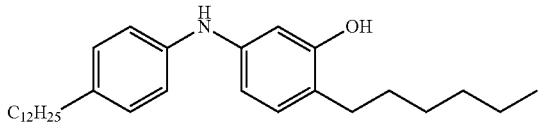

A 50 mL three-neck flask equipped with an overhead stirrer, thermocouple, and a Dean-Stark trap topped by a spiral condenser was charged with 16.7 g dodecyl aniline, 10.3 g 4-hexylresorcinol, and 0.8 g p-toluene sulfonic acid. The reaction was stirred at 200° C. for 4 h. The product was taken up in xylenes, extracted with aqueous sodium bicarbonate, and washed with water. Volatiles were removed by rotary evaporation, followed by vacuum distillation to yield the product as a dark orange oil.

Example 11

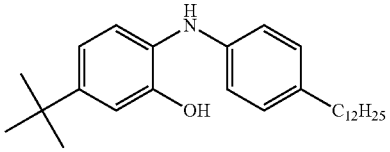

Using a procedure similar to that of Example 10, 16.6 g dodecyl aniline, 16.8 g 4-tert-butylcatechol, and 0.82 g p-toluene sulfonic acid were charged and stirred at 200-223° C. for 12 h. The reaction was worked up and distilled as above to yield the product as a viscous dark brown oil.

Example 12

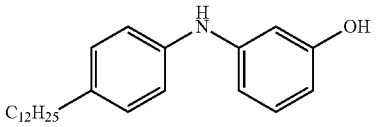

A 50 mL three-neck flask equipped with an overhead stirrer, thermocouple/nitrogen inlet, and short path distillation condenser was charged with 17.2 g dodecyl aniline, 7.3 g resorcinol, and 4.5 g basic alumina. The reaction was stirred at 220° C. for 20 h. An additional 3.3 g basic alumina was added, and the reaction was stirred at 220° C. for 7 h. An additional 3.6 g resorcinol was added, and the reaction at 220° C. for 28 h. The reaction mass was taken up in ethyl acetate and filtered through diatomaceous earth. Volatiles were removed by rotary evaporation followed by vacuum distillation to yield the product as a viscous dark red liquid.

Example 13

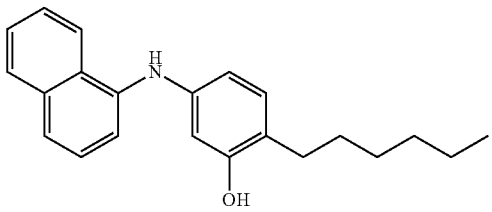

Using a procedure similar to that of Example 12, 21.2 g 3-hexylresorcinol, 9.2 g 1-naphthylamine, and 14.4 g basic alumina was stirred at 200-220° C. for 39 h using to yield the product as yellow brown crystals.

Example 14

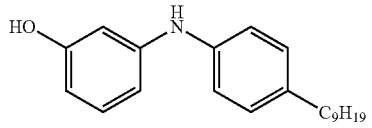

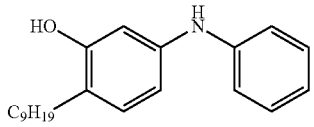

A 250 mL four-neck flask equipped with an overhead stirrer, thermocouple, spiral condenser and addition funnel was charged with 30 g 3-hydroxydiphenylamine, 5.8 g Filtrol 20X (oven dried 3 h at 150° C.) and 21.5 g propylene trimer. The reaction was heated to 140° C., and maintained at that temperature throughout the reaction. Additional propylene trimer (23.9 g) was added dropwise in two parts over 7 h, and the reaction was stirred for 4 h. A further 22.1 g propylene trimer was added dropwise in two parts over 8 h. A final 22.9 g propylene trimer was added dropwise in two parts over 5 h, and the reaction was stirred for an additional 5.5 h. The reaction mass was filtered through diatomaceous earth, and the filter pad rinsed with ethyl acetate. Volatiles were removed by rotary evaporation followed by vacuum distillation to yield the product as a clear light brown viscous oil.

Example 15

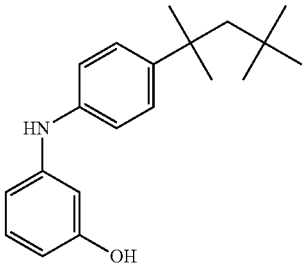

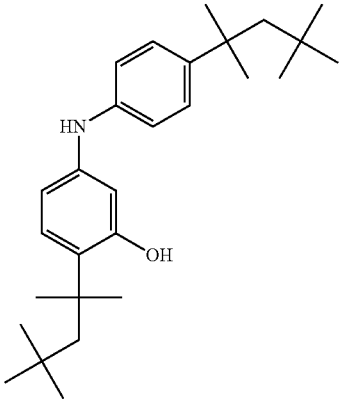

-continued

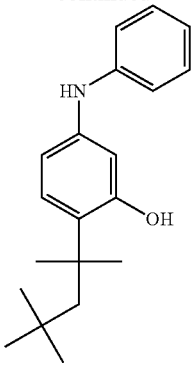

A 50 mL three-neck flask equipped with an overhead stirrer, a thermocouple and a 13 cm dry ice condenser (with septum, nitrogen inlet and a polyethylene needle reaching to the reaction), was charged with 12.64 g 3-hydroxydiphenylamine and 3.7 g Filtrol 20X (oven dried 3 h at 150° C.). The reaction was held at 138° C. while 2,4,4-trimethyl-1-pentene (31 mL) was added steadily over 23 h. The reaction mixture was diluted with ethyl acetate and filtered through diatomaceous earth. Volatiles were removed by rotary evaporation followed by vacuum distillation to yield the product as dark brown solid containing a 74:12:4 mixture of 3-hydroxy-4'-(1,1,3-3-tetramethylbutyl)diphenylamine: 3-hydroxy-4,4'-bis(1,1,3-3-tetramethylbutyl) diphenylamine: 3-hydroxy-4-(1,1,3-3-tetramethylbutyl)diphenylamine.

Example 16

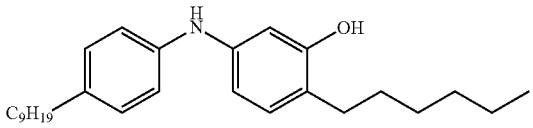

A 100 mL three-neck flask, equipped with an overhead stirrer, a Claisen head with a thermocouple and nitrogen inlet, and a short-path distillation apparatus was charged with 17.6 g 4-hexylresorcinol, 19.8 g nonylaniline, and 10.8 g basic alumina. The reaction was stirred at 220° C. for 41 h, then cooled. An additional 5.1 g basic alumina was added, and the reaction was stirred at 220° C. for 7 h. Temperature was increased to 232° C. for 18 h. The reaction mixture was taken up in ethyl acetate/hexanes and centrifuged. The supernatant was filtered through diatomaceous earth, and solvent was removed by rotary evaporation. Unreacted starting material was removed by vacuum distillation to yield 22.3 g clear orange liquid.

Results from TEOST and PDSC testing at 3 wt % loadings are shown below for compound 12 and 10 alone and in mixtures with NAUGALUBE 438L, NAUGALUBE APAN (alkylated phenyl naphthyl amine) or NAUGALUBE 531 (hindered phenol).

TEOST/PDSC results at 3 wt % Additive

| | Single Diarylamine | | Mixture w/50% NL 438L | | 25% NL 438L/ 75% Inventive Ex | |
|---|---|---|---|---|---|---|
| | TEOST | PDSC | TEOST | PDSC | TEOST | PDSC |
| 438L Standard | 20.7 | 26.7 | — | — | — | — |
| Ex 12 | 9.4 | 46.6 | 6.8 | 46.6 | 9.3 | 52.5 |
| Ex 10 | 6.4 | 19.5 | 10.6 | 30 | — | — |

TEOST/PDSC results at 3 wt % Additive

| | Single Compound | | Mixture w/50% NL APAN | | Mixture w/50% NL 531 | |
|---|---|---|---|---|---|---|
| | TEOST | PDSC | TEOST | PDSC | TEOST | PDSC |
| NL APAN | 16.3 | 22.1 | — | — | — | — |
| NL 531 | 50.2 | — | 10.2 | — | — | — |
| Ex 12 | 9.4 | 46.6 | 10.4 | 39.4 | 21.3 | — |
| EX 10 | 6.4 | 19.5 | 8.6 | 27 | 13.5 | |

Oxidation induction time by RPVOT:

| | 0.5% Single Additive | 0.25% NL 438NL/ 0.25% Example |
|---|---|---|
| N438L | 280 | — |
| Ex 12 | 770 | 1200 |
| Ex 10 | 340 | 650 |

What is claimed:

1. A lubricating oil composition comprising a) a lubricating oil, and b) a mixture of, based on the combined weight of i and ii, i) from about 10 to about 90 wt % of one or more alkylated hydroxydiphenylamine of formula

III

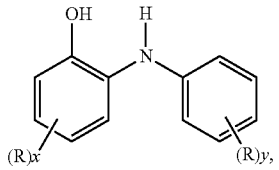

V

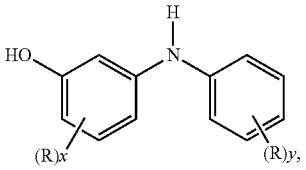

wherein x is 0 or 1 and y is 0, 1, 2 or 3, provided that at least one of x and y is other than 0;

each R is independently $C_{1-24}$ alkyl, or $C_{4-24}$ alkyl substituted by one or more hydroxyl or interrupted by one or more oxygen atom, wherein at least one carbon atom adjacent to the amine nitrogen is unsubstituted; and ii) from about 10 to about 90 wt % of one or more alkylated diphenylamines of the formula X:

X

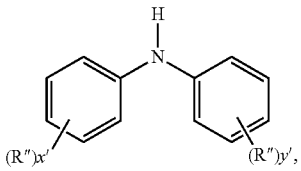

wherein x' is 1 or 2 and y' is 0, 1 or 2 and each R" independently from each other is $C_{1-24}$ alkyl; and wherein the mixture of b) is present in an amount of about 0.1 to about 5.0 wt %, based on the weight of the lubricating oil composition.

2. The lubricating oil composition according to claim 1 wherein the alkylated hydroxydiphenylamine is of the formula V.

3. The lubricating oil composition according to claim 1 wherein x is 0 or 1 and y is 1, 2 or 3.

4. The lubricating oil composition according to claim 1 wherein each R is independently $C_{1-24}$ alkyl.

5. The lubricating oil composition according to claim 1 wherein x is 0 or 1 and y is 1, 2 or 3 and each R is independently $C_{1-24}$ alkyl.

6. The lubricating oil composition according to claim 1 wherein x is 0 or 1 and y is 0, 1 or 2, provided that at least one of x and y is other than 0.

7. The lubricating oil composition according to claim 1 wherein each R" in formula X, independently from each other, is $C_{4-18}$ alkyl.

8. The lubricating oil composition according to claim 1 wherein each R is independently $C_{4-24}$ alkyl or $C_{4-24}$ alkyl interrupted by one or more oxygen atom.

9. The lubricating oil composition according to claim 1 wherein the lubricating oil comprises one or more hydrocarbon base stocks.

10. The lubricating oil composition according to claim 1 wherein when y is 1, (R)y contains at least four carbon atoms.

11. The lubricating oil composition according to claim 2 wherein when y is 1, (R)y contains at least four carbon atoms.

12. The lubricating oil composition according to claim 6 wherein the alkylated hydroxydiphenylamine is of the formula V.

13. The lubricating oil composition of claim 8 wherein the alkylated hydroxydiphenylamine is of the formula V.

14. The lubricating oil composition according to claim 12 wherein when y is 1, (R)y contains at least four carbon atoms.

15. The lubricating oil composition according to claim 6 wherein x is 0 or 1 and y is 1 or 2.

16. The lubricating oil composition according to claim 8 wherein x is 0 or 1 and y is 1 or 2.

* * * * *